US007621541B2

(12) United States Patent
Perkovich

(10) Patent No.: US 7,621,541 B2
(45) Date of Patent: Nov. 24, 2009

(54) SWIVELING AND PIVOTING CHASSIS FOR SKATES

(76) Inventor: Robert Perkovich, 1035 Southwood Dr., Apt. H, San Luis Obispo, CA (US) 93401

( * ) Notice: Subject to any disclaimer, the term of this patent is extended or adjusted under 35 U.S.C. 154(b) by 278 days.

(21) Appl. No.: 11/796,063

(22) Filed: Apr. 25, 2007

(65) Prior Publication Data

US 2008/0265533 A1 Oct. 30, 2008

(51) Int. Cl.
*A63C 17/06* (2006.01)

(52) U.S. Cl. ..... 280/11.231; 280/11.28

(58) Field of Classification Search ..... 280/841, 280/11.221, 11.223, 11.224, 11.231, 11.27, 280/11.28, 11.19, 11.232
See application file for complete search history.

(56) References Cited

U.S. PATENT DOCUMENTS 4,382,605 A * 5/1983 Hegna ..... 280/11.225
5,342,071 A * 8/1994 Soo ..... 280/11.207
5,582,418 A * 12/1996 Closser ..... 280/11.225
5,676,428 A * 10/1997 St. Laurent ..... 301/5.303
5,690,344 A * 11/1997 Chen ..... 280/11.28
5,704,620 A * 1/1998 Oliemans et al. ..... 280/11.225
6,098,997 A * 8/2000 Cheng ..... 280/11.28
6,105,977 A * 8/2000 Bengtsson et al. ..... 280/11.231
6,113,112 A * 9/2000 Kubelka ..... 280/11.231
6,161,846 A * 12/2000 Soderberg ..... 280/11.225
6,481,726 B2 * 11/2002 Alfieri et al. ..... 280/11.224
7,303,196 B2 * 12/2007 Harper ..... 280/11.28

* cited by examiner

*Primary Examiner*—Paul N Dickson
*Assistant Examiner*—Brian Swenson
(74) *Attorney, Agent, or Firm*—Andrew Schroeder

(57) ABSTRACT

An articulating chassis for skates with accompanying boot comprises: a plurality of brackets, a first set of rollers and a second set of rollers, and at least one articulating member. The brackets have a first side and a second side. The first side affixes with the boot and the second side affixes with the rollers. The first set of rollers having a first side, a second side, and a rolling surface. The second set of rollers having a top side and a bottom side and a tread surface. The rolling surface of the first set of rollers has a width smaller than the tread surface of the second set of rollers.

2 Claims, 11 Drawing Sheets

SWIVELING AND PIVOTING CHASSIS FOR SKATES

FIELD OF THE INVENTION

The present invention relates with an improved chassis apparatus for skates.

BACKGROUND OF THE INVENTION

One of the more popular recreational activities and sports today are roller-blading, roller-hockey (or floor-hockey), similar to slalom skiing, and similar activities which implement the use of feet apparel with a rolling means for human-powered propulsion. For some people these skates are used in either team-related competition or individual competition. For others, theses skates are used for exercise and recreation. In many of these activities, there is a need for increased agility. This need is especially pronounced for the purpose of turning without taking a person's feet off the ground. This increased agility may enable a person to perform moves which were otherwise impossible with their skates.

In team competition, increased agility may enable a person to move past a defender, or position himself to cut off an offensive attack. Increased agility may also enable one to better avoid various objects and debris frequently encountered on sidewalks, parks, and streets.

Unfortunately, the current marketplace only provides skates which incorporate a completely unitary and non-articulating chassis. These chassis do not enable a person to make quicker, tighter turns. Instead, this unitary chassis design impedes the possible agility a person might ordinarily enjoy with an articulating chassis.

Another need which all skaters have is a means for stopping. Currently, most of the devices in the marketplace incorporate various stopping means on skates which are clumsy and do not provide for a smooth stop. The need for a smooth and graceful stop is also an important safety concern as well.

Therefore, what is clearly needed in the art is an improved chassis for roller skates with a pivoting and swiveling chassis for the purpose of providing increased agility for its users. The improved chassis should provide for lateral motion in between the wheel assembly for tighter or softer turns for the user. In addition, the improved chassis should provide for vertical movement of front and rear wheels for braking. Moreover, the marketplace also needs an improved chassis for the purpose of providing a more smooth and graceful stop for its users.

SUMMARY OF THE INVENTION

It is an object of the present invention to provide an improved chassis which swivels and pivots thereby providing increased agility for its users. This is provided by enabling the chassis to bend at various pre-determined points along the length of the chassis. The chassis is enabled in part through the use of springs which enable the chassis to revert to its straightened form. This lateral movement may enable a user to make sharper turns or more rounder turns.

Another object of the present invention is to provide an improved stopping means for its users. This improved stopping means is provided through use of a vertically pivoting lead and rear wheels enabled to move up or down thereby creating the frictional resistance for providing a smoother stop.

BRIEF DESCRIPTION OF THE DRAWING FIGURES

FIG. 1*a* is a plan view of a preferred embodiment of the present invention.

FIG. 1*b* is a plan view of a preferred embodiment of the present invention.

DESCRIPTION OF PREFERRED EMBODIMENTS

Figure 1A:
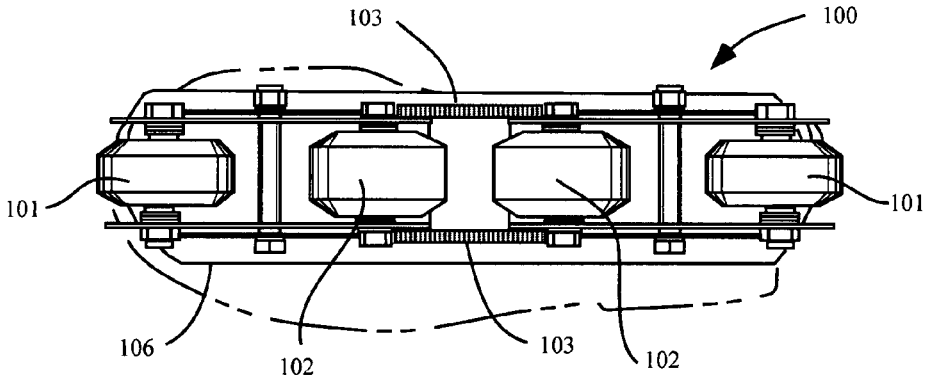

According to a preferred embodiment of the present invention, a unique skating chassis is incorporated for the purpose of improved and increased agility and improved stopping means. This increased agility is enabled without pulling a person's feet off the ground. The means for stopping also acts to propel a person from a resting or idle position. The present invention is described in enabling detail below.

For the purposes of the present invention, the term "chassis" shall refer to the assembly of the apparatus which connects to the bottom of the shoe which attaches to the wheels. It should be noted that the present invention does not include the boot, or the apparatus which houses the boot. The present invention merely encompasses the apparatus which enables the propulsion of the user which is embodied in the chassis.

For the purposes of the present invention the term "spring" refers to the elastic or bendable member which enables the chassis to move, bend, and revert back to its original shape.

For the purposes of the present invention the terms "wheels" and rollers are interchangeable. Since either wheels or rollers may be equally suitable for the purposes of the present invention, either may be used. Moreover, the terms "wheels" or "rollers" may further incorporate within its scope any objects upon which something normally rides upon thereby enabling propulsion.

FIGS. 1-5 illustrate a preferred embodiment of the present invention. An articulating chassis for skates 100 incorporates a plurality of brackets 104, 105, a first set of narrow rollers 101, and a second set of wide rollers 102, and at least one articulating member 103.

Figure 10:
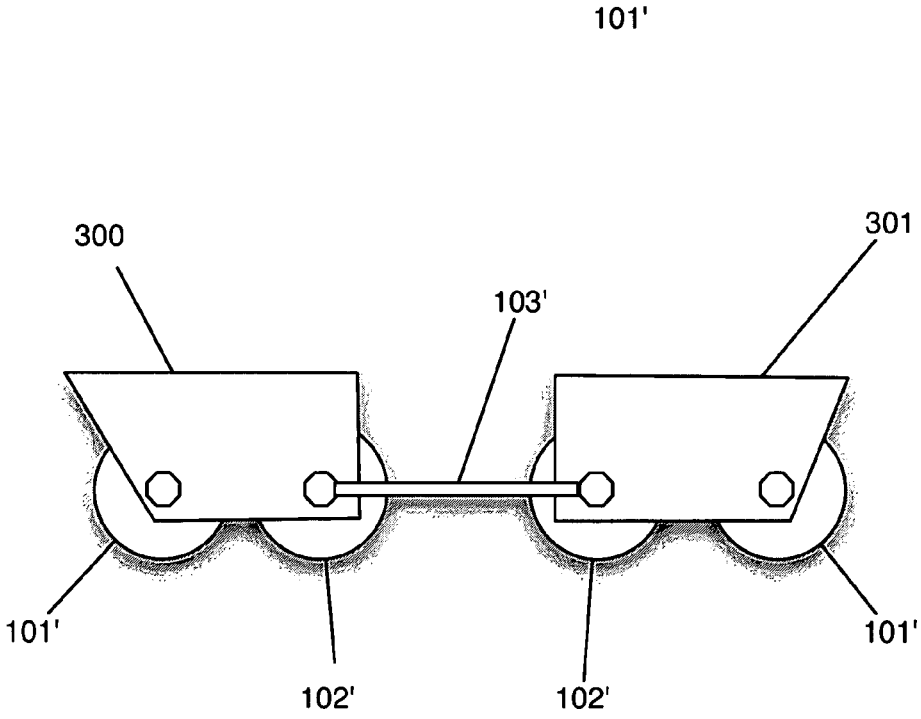
FIG. 10 is a side view of a preferred embodiment of the present invention.
Figure 11:
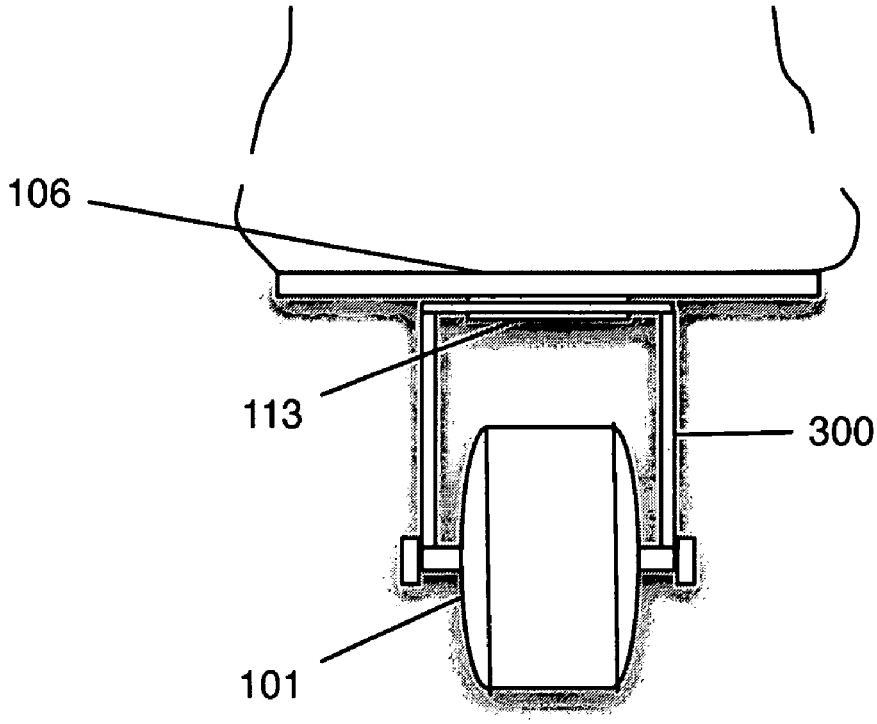
FIG. 11 is a frontal view of a preferred embodiment of the present invention.
Figure 12:
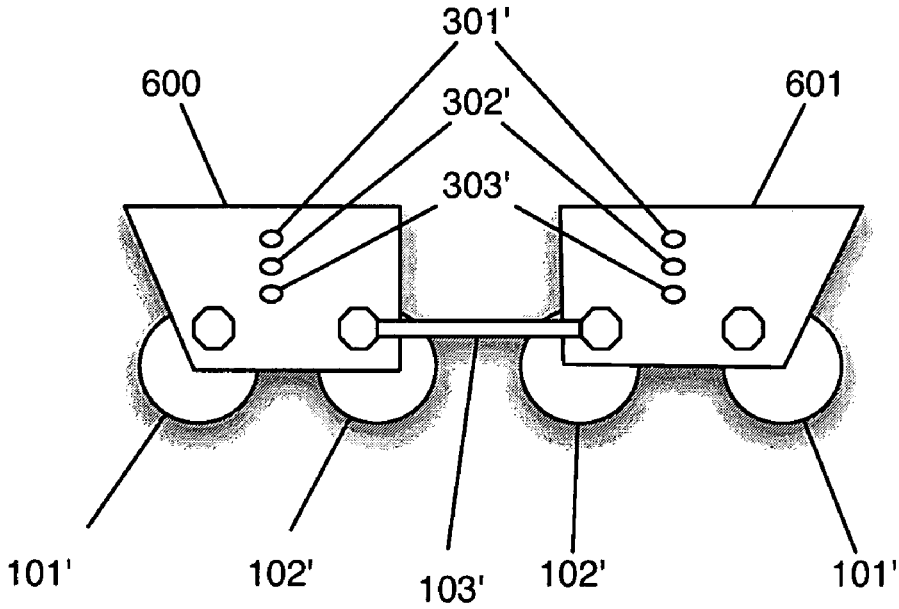
FIG. 12 is a side view of a preferred embodiment of the present invention.

It should be noted here that in some alternative preferred embodiments there will only be one set of brackets which hold the rollers. Therefore brackets 104 and 105 may be a single piece as illustrated in FIGS. 10-11 which is denoted by number 300 and 301. This alternative chassis style or embodiment will be denoted by 100'.

Figure 13:
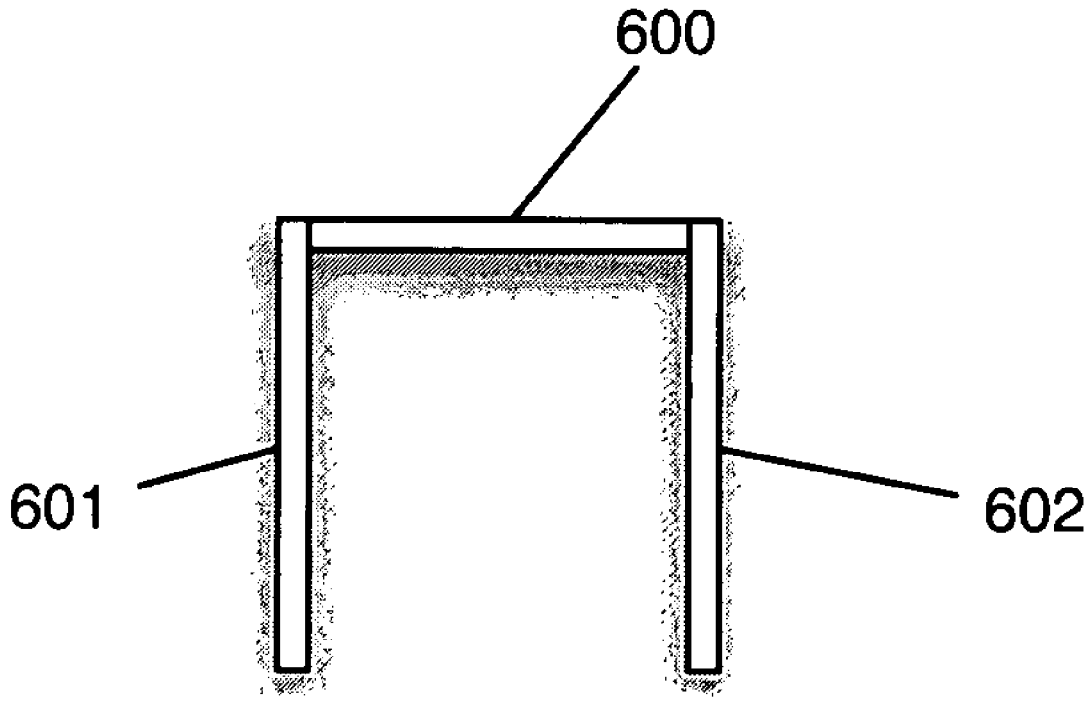
FIG. 13 is a frontal view of a preferred embodiment of the present invention.

The brackets have a first side 600, a second side 601 and a third side 602 as illustrated in FIG. 13. In some preferred embodiments the first side affixes with the boot and the second and third sides affixes with the rollers.

Figure 15:
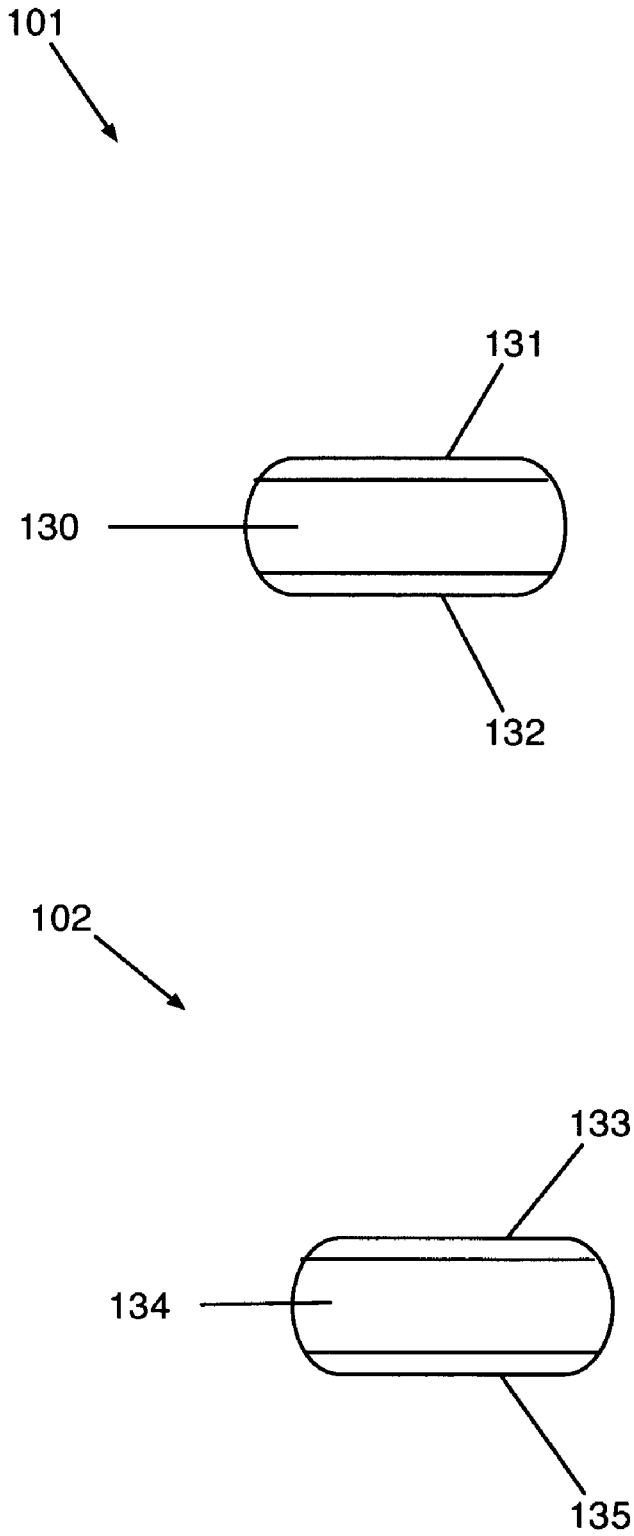
FIG. 15 is a plan view of a preferred embodiment of the present invention.

FIG. 15 illustrates that the first set of rollers has a first side 131, a second side 132, and a rolling surface 130. The second set of rollers having a top side 133, a bottom side 135 and a tread surface 134. The rolling surface of the first set of rollers has a width smaller than the tread surface of the second set of rollers.

Figure 7:
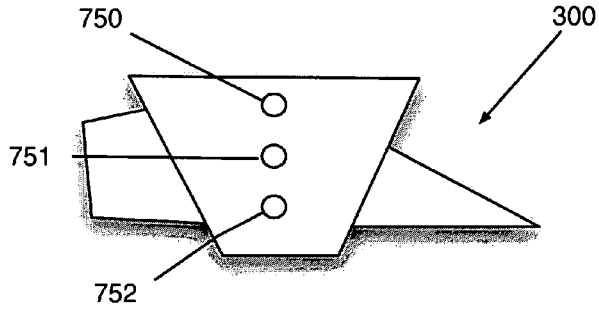
FIG. 7 is a side view of a preferred embodiment of the present invention.

FIG. 7 illustrates that the carriage bracket is enabled with a plurality of optional brake orifices 750, 751, and 752. These orifices retain the braking pin and will enable varying degrees of braking performance. For instance, braking orifice #1 301 is designed to be slower whereas braking orifice #3 303 is designed to be faster. A slower brake position is more suitable for sports such as hockey whereas a faster brake may be more desirable for novice skaters or elderly skaters. These optional braking positions enable the user to freely change the braking performance to his or her desired specifications.

The brackets are articulably connected with each other with at least one articulating member. In some preferred embodiments the articulating member is a spring. However, in other preferred embodiments the articulating member may be substituted with another resilient member. Examples include but are not limited to rubber, bungee, cord or the like. As such, the articulating member is not meant to be construed as limiting to only springs.

Figure 2:
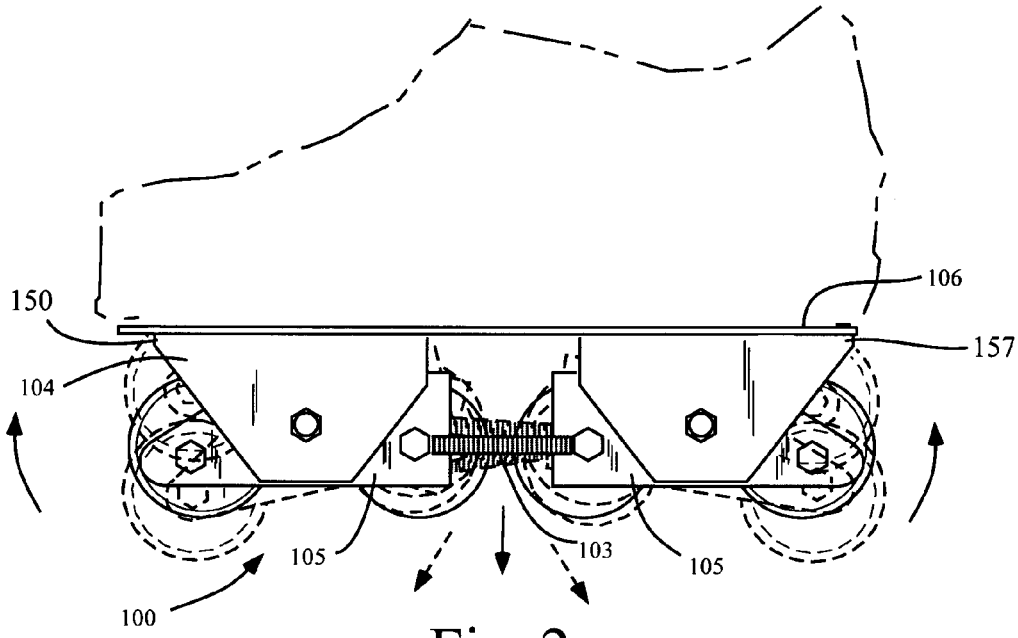
FIG. 2 is a side view of a preferred embodiment of the present invention.
Figure 3:
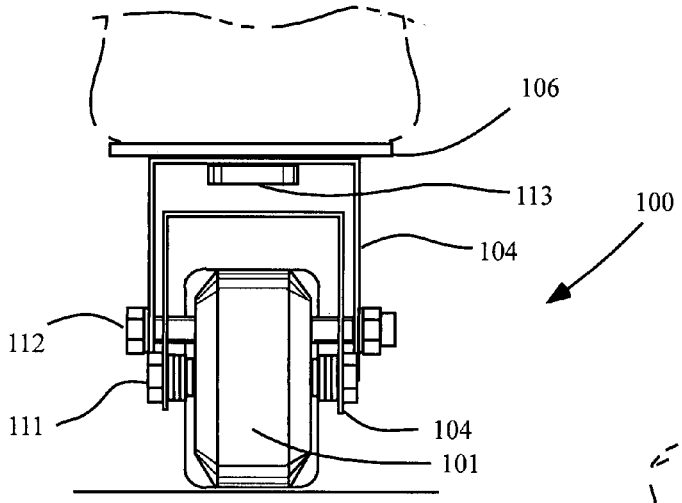
FIG. 3 is a frontal view of a preferred embodiment of the present invention.
Figure 4:
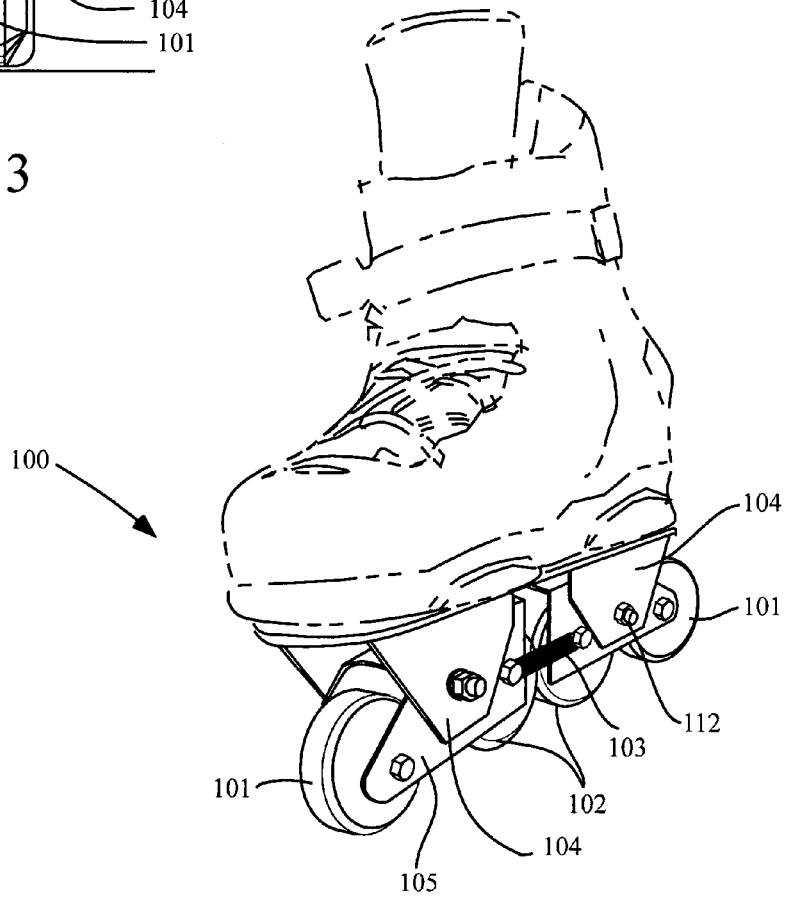
FIG. 4 is a perspective view of a preferred embodiment of the present invention.
Figure 5:
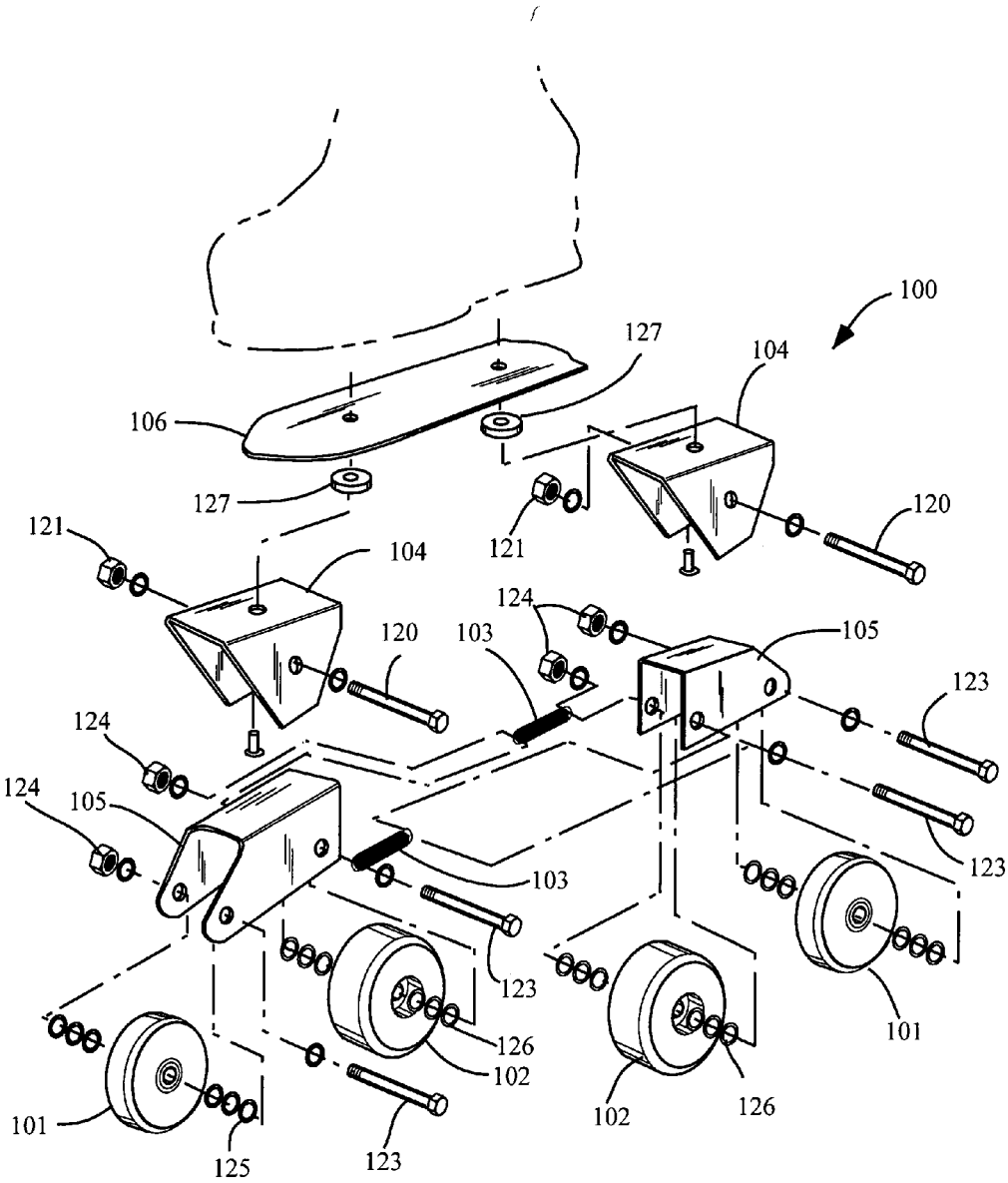
FIG. 5 is an exploded view of a preferred embodiment of the present invention.

In other preferred embodiments, the chassis incorporates a set of "stop and go" rollers wherein the first set of rollers are articulably connected with the brackets as illustrated in FIG. 2. The first set of rollers are articulably mounted such that the first set of rollers may move in an upwardly and downwardly motion. This enables a user to come to a complete stop. This action is produced by creating decelerating friction between the tread surface of the first set of rollers and the bracket.

Figure 6:
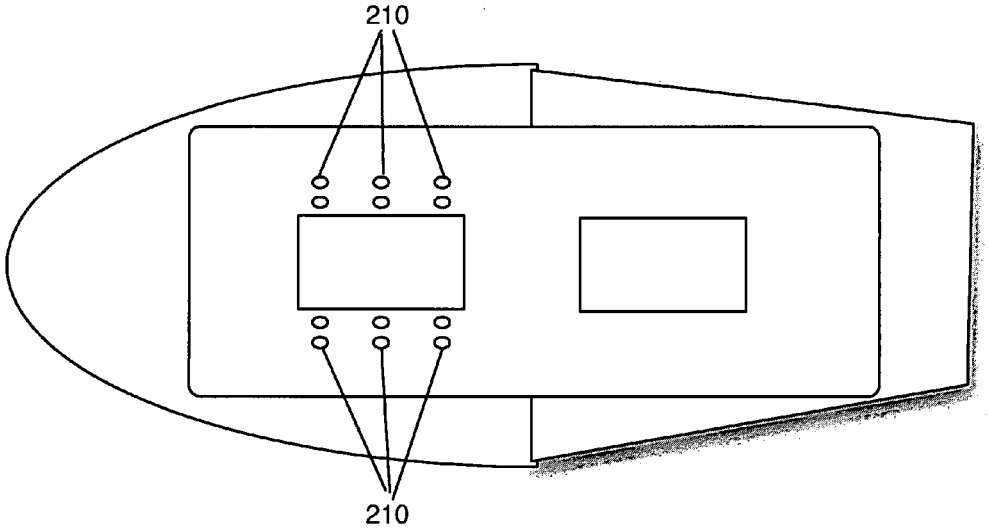
FIG. 6 is a plan view of a preferred embodiment of the present invention.
Figure 8:
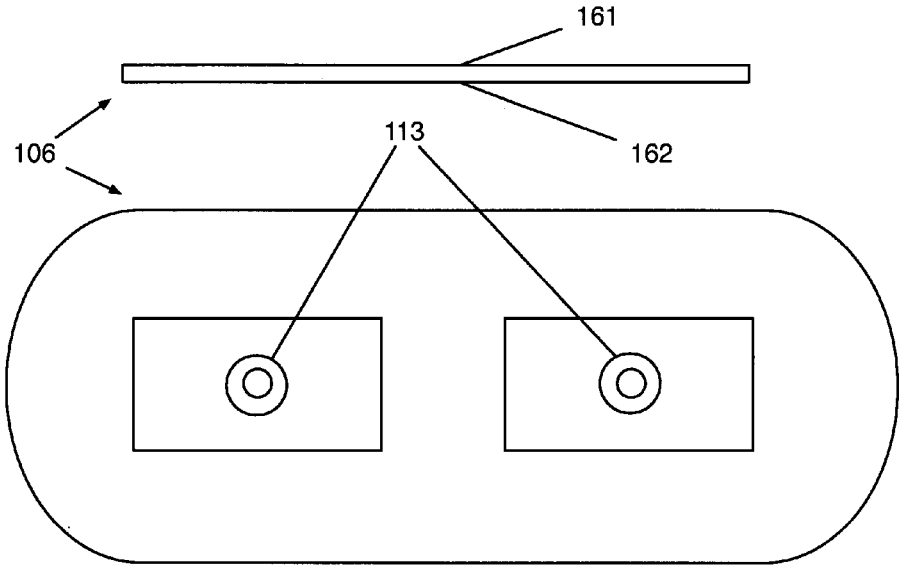
FIG. 8 is a plan and side view of a preferred embodiment of the present invention.
Figure 14:
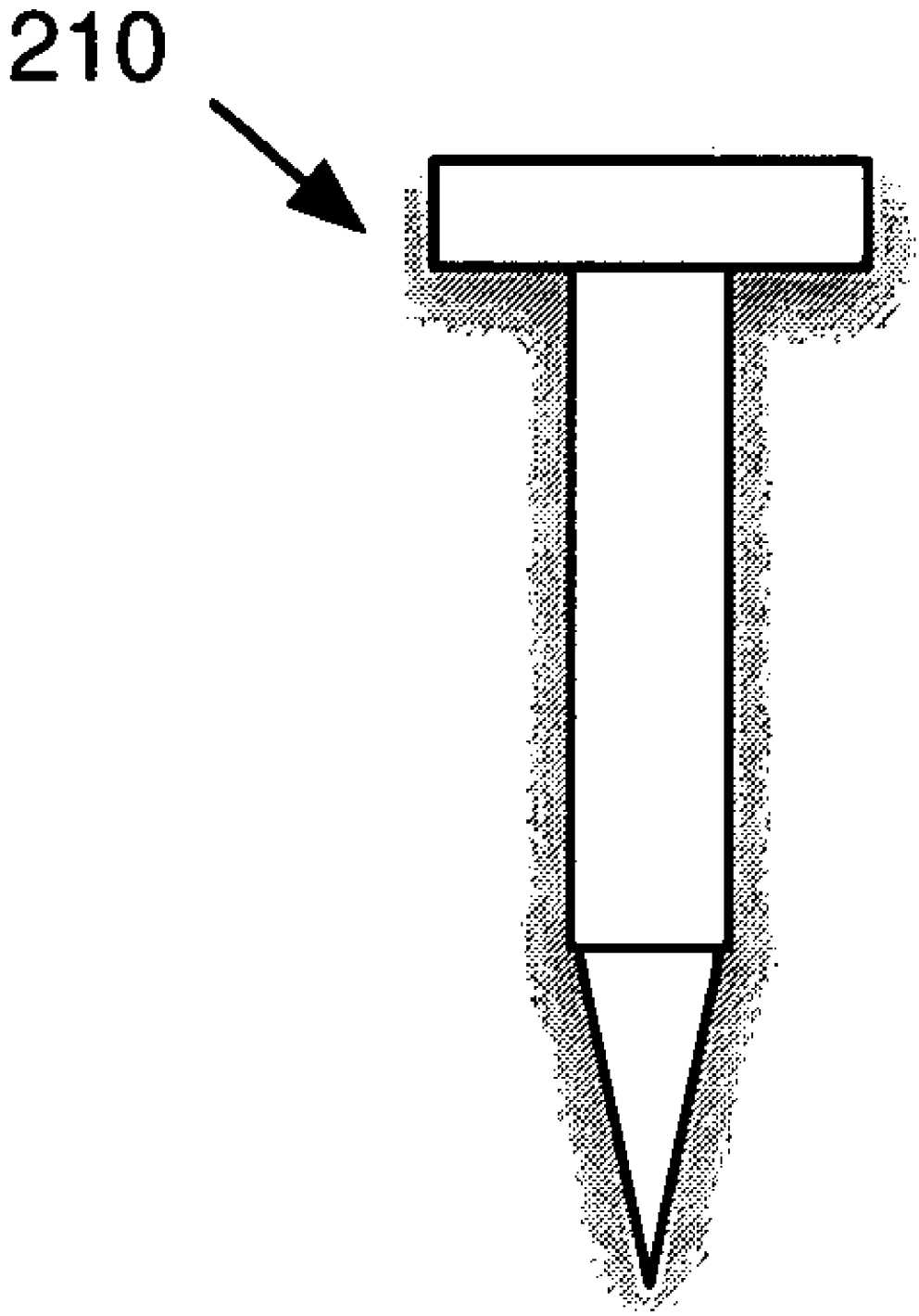
FIG. 14 is a frontal view of a preferred embodiment of the present invention.

FIG. 8 illustrates that in some preferred embodiments the chassis may further comprise a platform 106. The platform is an elongate planar member with a top surface 161 and a bottom surface 162. The top surface affixes with the boot and the bottom surface affixes with the brackets. And for the purpose of providing an impeding mechanism, the platform may further comprise a plurality of stopping studs 210 as illustrated in FIG. 6 and in FIG. 14. The purpose of the studs is to restrict the arc of the swiveling brackets. Studs are affixed in a plurality of threaded holes. The threaded holes are more numerous than the studs themselves. For this reason, the user has the option of positioning the studs in such a way to enable more swiveling of the brackets or less swiveling of the brackets. In some preferred embodiments these studs may be screws or similar fasteners which are disposed within a threaded orifice.

Figure 9:
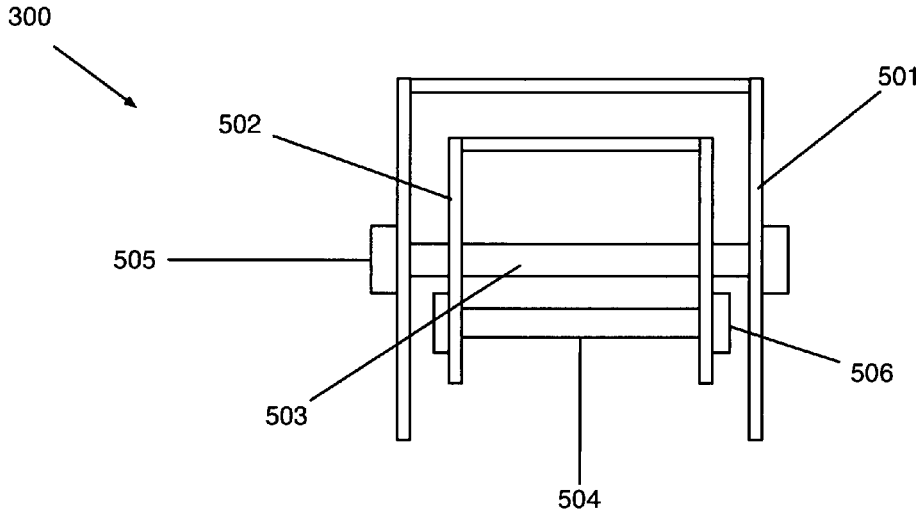
FIG. 9 is a frontal view of a preferred embodiment of the present invention.

FIGS. 7 and 9 illustrates a carriage bracket 300 which may be used in some preferred embodiments. The carriage bracket consists of a swivel bracket 501 and a braking bracket 502. The swivel bracket is affixed to the boot through the swivel washers 113 illustrated in FIG. 8. The swivel bracket is articulable such that it may rotate itself with respect to the boot.

Figure 1B:
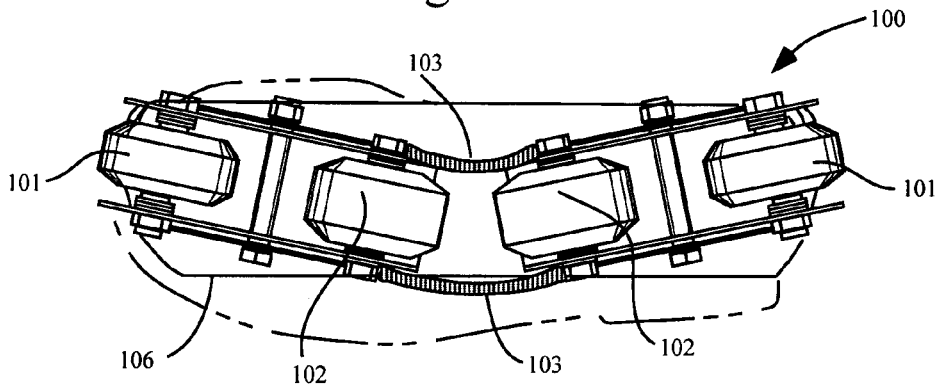

FIG. 9 illustrates that the braking bracket is affixed with the swivel bracket through the braking pin 503. The braking pin is retained by a pair of nuts 505. The braking pin enables the braking bracket to articulate vertically so that it may stop the skate by forcing the rollers to create frictional resistance by pushing the rollers against braking surfaces 150, 157 as illustrated in FIG. 1. The braking bracket retains the roller through the roller pin 504.

Those skilled in the art will appreciate numerous variations in the present system, configuration and operation that are within the scope of the invention. Those skilled in the art will also appreciate how the principles illustrated in these preferred embodiments can be used in other examples of the invention. A particular reference number in one figure refers to the same element in all of the other figures.

Moreover, It will be apparent to the skilled artisan that there are numerous changes that may be made in embodiments described herein without departing from the spirit and scope of the invention. As such, the invention taught herein by specific examples is limited only by the scope of the claims that follow.

What is claimed is:

1. An articulating chassis for skates comprises: a plurality of brackets, a first set of rollers and a second set of rollers, a platform, a plurality of stopping studs, and at least one articulating member;

the stopping studs are disposed in a position which prevent over-extension of the rollers when turning;

the platform is an elongate planar member with a top surface and a bottom surface and at least one stud;

the top surface affixes with the boot and the bottom surface affixes with the brackets the articulating member is a spring the first set of rollers having a first side, a second side, and a rolling surface;

the first set of rollers are articulably mounted such that the first set of rollers may move in an upwardly and downwardly motion;

the second set of rollers having a top side and a bottom side and a tread surface;

the rolling surface of the first set of rollers has a width smaller than the tread surface of the second set of rollers;

the brackets are articulably connected with each other with at least one articulating member;

the brackets comprise at least two brake orifices for the purpose of customizing the performance of the skates.

2. An articulating chassis for skates with accompanying boot comprises: a plurality of rollers, a platform, at least two upper brackets, and at least two lower brackets, and at least one articulating member;

the platform is a substantially planar member having a top side and a bottom side; the top side is oriented towards the boot and the lower side is oriented towards the lower brackets;

the upper brackets having a first side and a second side; the first side of the upper brackets affixes to the bottom side of the platform and the second side of the upper brackets affixes to the lower brackets;

the lower brackets are affixed to the rollers and are connected to each other by the articulating member.

* * * * *